US005211605A

United States Patent [19]

Shiga et al.

[11] Patent Number: 5,211,605

[45] Date of Patent: May 18, 1993

[54] INCOMBUSTIBLE DIFFUSER ASSEMBLY FOR PREVENTING DEW CONDENSATION IN AIR-CONDITIONING SYSTEMS

[75] Inventors: Takeo Shiga; Yoshihide Arakawa, both of Yokohama, Japan

[73] Assignee: Senbec Kabushiki Kaisha, Tokyo, Japan

[21] Appl. No.: 799,271

[22] Filed: Nov. 27, 1991

[30] Foreign Application Priority Data

Nov. 28, 1990 [JP] Japan ..... 2-326353

[51] Int. Cl.[5] ..... F24F 7/00

[52] U.S. Cl. ..... 454/284; 454/292; 454/300

[58] Field of Search ..... 454/284, 292, 299, 300

[56] References Cited

U.S. PATENT DOCUMENTS

| | | | |
|---|---|---|---|
| 3,232,206 | 2/1966 | Kennedy | 454/300 |
| 3,311,044 | 3/1967 | Marino | 454/300 |
| 4,159,674 | 7/1979 | Brumleu | 454/297 |
| 4,266,470 | 5/1981 | Schroeder | 454/297 |

*Primary Examiner*—Robert G. Nilson

*Attorney, Agent, or Firm*—Wenderoth, Lind & Ponack

[57] ABSTRACT

A diffuser assembly for an air-conditioning installation, has low thermal conductivity so that it can prevent from accumulating condensation and is incombustible enough. Each of the diffuser elements of the diffuser assembly contains 90% by weight or more of an inorganic fiber material or an inorganic material composed mainly of inorganic fibers and obtained by molding and curing with the use of a binder. The inorganic fibers used are preferably ceramic or polycrystalline mullite fibers.

18 Claims, 3 Drawing Sheets

INCOMBUSTIBLE DIFFUSER ASSEMBLY FOR PREVENTING DEW CONDENSATION IN AIR-CONDITIONING SYSTEMS

BACKGROUND OF THE INVENTION

1. Field of the Invention

This invention relates to an air-conditioning installation and, more particularly, to an incombustible diffuser assembly for preventing dew condensation in air-conditioning installation.

2. Prior Art

In an air-conditioning installation, the terminal end of its duct system is fixed to a ceiling or wall, and is provided with a diffuser assembly through which air streams are diffused indoors.

Depending upon the intended patterns of the air streams, the diffuser assemblies may take various forms such as planar vane grating, linear slot, dot-like Anemostat and pan forms, as known in the art.

These diffuser assemblies are all equipped with diffuser elements, which are molded of steel, aluminum or other sheets into desired shapes, and are then baked and coated on their surface with melamine, etc. For instance, the most generally used Anemostat type diffuser assembly is provided with annular diffuser elements of a conical shape in section and spaced at given intervals, said diffuser elements being molded of aluminum sheet and coated on their surfaces.

On the other hand, the vane grating type diffuser assembly, for instance, may be provided with diffuser elements obtained by integral molding of aluminum or other type of sheets.

However, the above diffuser elements molded of such metal materials as steel and aluminum sheets are likely to accumulate indoor moisture on their surfaces and be cooled, resulting in dew condensation. This in turn causes the diffuser assemblies to be stained or dewdrops to trickle down indoors.

With diffuser elements formed of synthetic resin lower in thermal conductivity than metals, it is possible to prevent dew condensation to some extent. Because of is combustibility, however, the synthetic resin is not very suitable for diffuser assemblies—a sort of architectural material essentially required to have incombustibility, which are to be fixed to ceilings, walls or elsewhere for use. In many countries, applying synthetic resin diffuser assemblies to ceilings, walls or elsewhere is now prohibited by law.

SUMMARY OF THE INVENTION

In view of the foregoing, a major object of this invention is to provide an incombustible diffuser assemblies for preventing dew condensation in air-conditioning installation, which is provided with an array of diffuser elements capable of preventing dew condensation completely and made of incombustible material.

In order to attain the above object, this invention provides a diffuser assembly built up of diffuser elements, each made of an inorganic material which is of low thermal conductivity and is incombustible in and of itself. In particular, each of the diffuser element is characterized in that it is obtained by molding and curing 90% by weight or more, preferably 95% by weight or more, of an inorganic material which is composed only of inorganic fibers or composed mainly of inorganic fibers and additionally of inorganic powders with the use of 10% by weight or lower, preferably 5% by weight or lower, of a binder.

According to this invention, there are thus provided an incombustible diffuser assembly for preventing dew condensation in an air-conditioning installation, which includes a plurality of diffuser elements, each obtained by molding and curing 90% by weight or more of an inorganic fiber material with a binder;

an incombustible diffuser assembly for preventing dew condensation in an air-conditioning installation, which includes a plurality or diffuser elements, each obtained by using an inorganic material composed mainly of inorganic fibers and additionally of inorganic powders in place of the above inorganic fiber material;

an incombustible diffuser assembly for preventing dew condensation in air-conditioning installation, wherein the above inorganic fiber material or inorganic fibers are inorganic ceramic fibers;

an incombustible diffuser assembly for preventing dew condensation in an air-condition installation, wherein the above inorganic fiber material or inorganic fibers are any one of polycrystalline mullite, glass and rockwool fibers; and an incombustible diffuser assembly for preventing dew condensation in an air-conditioning installation, wherein the above binder is made up of polyvinylalcohol and water glass.

The diffuser assemblies mentioned above presents the accumulation of condensation, is incombustible, is light and exhibits high impact resistance.

BRIEF DESCRIPTION OF THE DRAWINGS

This invention will now be explained specifically but not exclusively with reference with the accompanying drawings, in which.

DETAILED DESCRIPTION OF THE INVENTION

Figure 1:
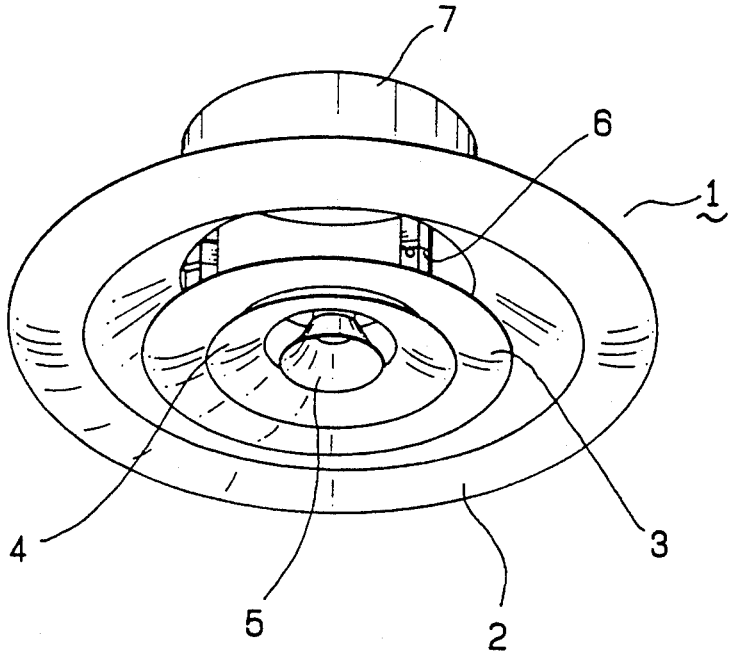
FIg. 1 is a perspective view of an Anemostat type diffuser assembly according to one embodiment of this invention.
Figure 2:
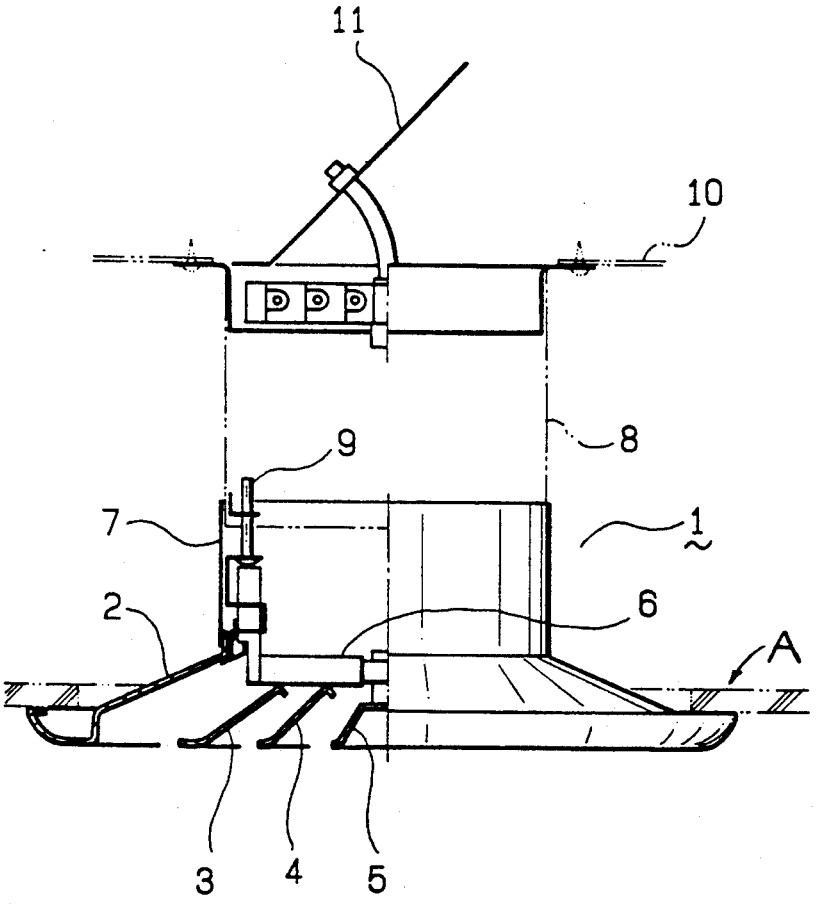
FIG. 2 is a partly cut-away sectional view of that diffuser assembly attached to a ceiling.

Referring to FIGS. 1 and 2, there is illustrated an Anemostat type diffuser assembly shown generally at 1, which is embedded in the ceiling A and forms an end part of the duct system of an air-conditioning apparatus. As conventional, the diffuser assembly 1 includes means for controlling the directional flow pattern of air in the form of a plurality of diffuser elements 2-5, each having the shape of a truncated-cone and fixed to a support frame 6, with air-diffusing spaces kept between them. In this state, it is further held by and fixed to a downward, intermediate metal duct 8 coupled to a duct main 10.

In this embodiment, the diffuser elements 2-5 are each obtained by molding an amount, preferably 95% by weight or more, of an inorganic material together with binders into a truncated-cone shape, following by curing.

In a preferred embodiment, the inorganic material is in the form of inorganic ceramic fibers having a maximum length of 80 mm, an average diameter of 2.5 μm and a specific gravity of 2.73, consisting of an amorphous structure and containing 48% by weight of $Al_2O_3$ and 52% by weight of $SiO_2$, for instance, FIBERFRAX FFX bulk fibers made by Toshiba Monoflux Co., Ltd. This material is then dispersed in a water-based binder containing 2% by weight of PVA and 3% by weight of water glass. The resulting dispersion is premolded and then molded and cured under pressure for 1 minute, while heated at 80° C. for moisture evaporation and PVA dissolution, thereby obtaining a molded element having a density-after-molding of 0.8 kg/m$^3$ and a thickness of 2 mm.

Each of the thus obtained diffuser elements 2-5 is coated on its surface with fine powders of kaolin dispersed in water glass and then dried for sealing purposes. After sealing, it is bake-finished on its surface with melamine, thereby imparting an attractive appearance to it.

In FIGS. 1 and 2, reference numerals 7, 9 and 11 designate a mounting ring, a mounting screw and a damper respectively.

The diffuser elements 2-5 are each finely porous, hard and improved in strength with no interlaminar separation.

In order to make certain of the capability to prevent dew condensation of the above diffuser elements in the Anemostat type diffuser assembly 1, comparative tests were carried out with conventional diffuser elements formed of an aluminum sheet. To this end, a cooled thermo-hygrostat chamber constructed following a room to be air-cooled was connected through sample diffuser elements to the front side of a box corresponding to the ceiling. Then, what surface states the sample diffuser elements were in was observed after they had been held at a constant humidity of 81% and for 3 hours and 6 hours at varied temperatures of 20.8° C., 30.8° C. and 40.2° C. The comparative diffuser elements formed of an aluminum sheet were all found to have condensation accumulated over all of the surfaces, with dewdrops trickling down locally or wholly. However, the diffuser elements according to this invention did not vary at both 20.8° C. and 30.8° C., and were found to be slightly softened at 40.2° C.; that is, they showed no sign of dew condensation at all.

Figure 3:
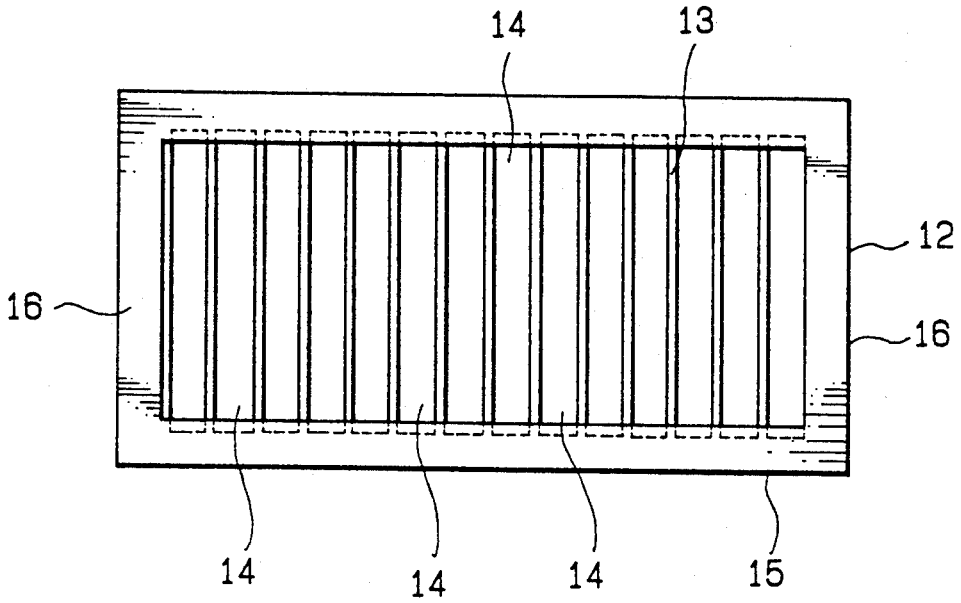
FIG. 3 is a front view of a diffuser assembly according to another embodiment of this invention.
Figure 4:
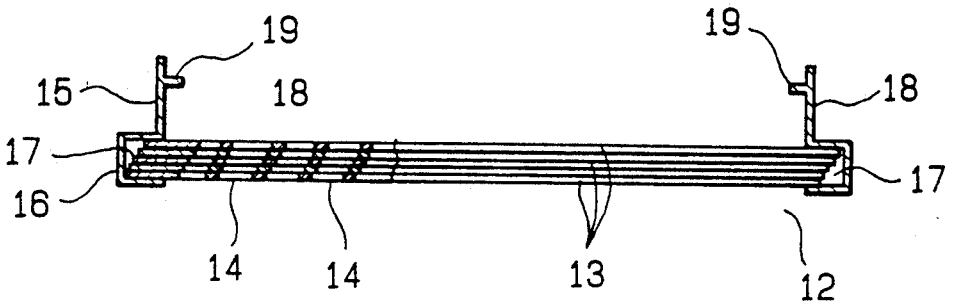
FIG. 4 is a cross-sectional view of the diffuser assembly shown in FIG. 3.

Referring next to FIGS. 3 and 4, there is shown a diffuser assembly 12 capable of diffusing the air in various directions, which is used in place of a conventional vane grating type diffuser assembly. In this embodiment, a plurality of diffuser elements 13, each in the form of a rectangular flat plate having a thickness of 2 mm and obtained by molding and curing, are provided with longitudinal slots 14 of, e.g., 20 mm in width. The diffuser assembly 12 is constructed by putting an assembly of the diffuser elements 13 in a rectangular support frame 15. A clearance 17 of about 3 cm is left between the support frame 15 and each diffuser element 13 so that when the diffuser assembly 12 is put in the frame, each diffuser element 13 is horizontally slidable.

Accordingly, if a fine rod, for instance, is inserted into each slot 14 and turned on the front side on one direction, then it is possible to achieve an angular displacement of each slot 14, thereby arbitrarily adjusting the direction of the air to be diffused indoors.

Note that each diffuser element 13 in this embodiment is similar to that in the first embodiment in terms of its material, its formation by molding and curing, its density, etc., and the support frame 15 is formed of a similar, highly insulating material as well. In FIGS. 3 and 4, references numeral 16 represented an edge portion of the frame 15 for receiving the diffuser elements 13, 18 a mounting edge portion of the frame 15 to be embedded in the ceiling or wall, and 19 a fin fixed on the mounting edge.

As in the case of the first embodiment, this diffuser assembly 12 showed no sign of dew condensation at all in comparative tests performed with a conventional one including metal diffuser elements.

While the two specific embodiments of this invention have been described, it is understood that in so far as this invention is concerned, as the inorganic fiber material not only is the above ceramic fibers usable but other fibers, like polycrystalline mullite fibers (again made by Toshiba Monoflux Co., Ltd.), glass fibers and rockwool fibers, may be employed as well. It is also understood that the inorganic fiber material, if composed mainly of such fibers as mentioned above, may be partly replaced with powders of other inorganic material. Even in this case, however, it is essentially required that the molded and cured element be kept porous; care should be taken of the fact that the greater the amount of inoganic material other than the fibers, the more difficult it is to perform molding and curing.

The inorganic material, if composed only or mainly of inorganic fibers, should account for 90% by weight or more, preferably 95% by weight or more, of the diffuser element. Below 90% by weight, it makes no sufficient contribution to making sure of incombustibility and so does not lend itself fit for the purpose of this invention. Note that on condition that the inorganic material is used in an amount of 90% by weight or more, it is possible to use about 0.5 to 5% by weight of organic fibers such as POVAL (polyvinylalcohol).

The binder, if used in an amount of at most 10% by weight, may be a combustible one. In this case, however, it is noted that the heating temperature for molding and curing should be brought up to, e.g., about 200° C., although this depends upon what type of binder is used. It is also noted that when PVA is used as the binder, its amount should lie in the range of 0.5 to 5% by weight, and when an organic binder such as water glass is used, its amount should lie in the range of 1 to 10% by weight.

The diffuser element may be formed by air-blow or electrostatic deposition techniques, cast molding or other techniques, which may be used alone or in combination. According to this invention, premolding may be used as well.

In general, the diffuser element obtained by molding and curing should preferably have a density in the range of 0.7 to 1.2 kg/m$^3$. Below the lower limit, it is not necessarily easy to make sure of sufficient heat insulating properties in a porous state, and above the upper limit, the inorganic fiber material is likely to felt up, rendering it difficult to allow the resulting diffuser elements to maintain shape-retaining strength.

Preferably, the diffuser element should be coated on its portions exposed to open view, thereby imparting an attractive appearance to it. In this case, it is generally required that the porous surface of the diffuser element be sealed. As the sealing agent applied to this end, not only is the above kaolin usable but fine inorganic powers such as polishing, clay or talc powders may be used as well.

In order that ill effects by dew condensation are avoided directly and effectively, in incombustible diffuser assembly for preventing dew condensation according to this invention is advantageously used while fixed to the ceiling, e.g., in various forms including the above Anemostat, pan and rectangular forms. However, this diffuser assembly may be used while fixed to a wall or floor. In practicing this invention, many changes or modifications may be used possible in terms of material, shape, structure and density without departing from the purport of the invention. It is thus understood that this invention is never limited to the above two specific embodiments.

As mentioned above, this invention successfully provides a diffuser assembly for an air-conditioning installation, which both prevents dew condensation and is incombustible because it includes a plurality of diffuser elements each containing an inorganic material in an amount of 90% by weight or more, thereby decreasing thermal conductivity and so preventing dew condensation completely.

Since the diffuser element is composed only or mainly of inorganic fibers, it is much lighter than a diffuser element made up of other inorganic materials and, besides, has high strengths including impact strength. This enables the diffuser element to be prevented from transforming or breaking down at the time of installation. The diffuser elements can be so variously shaped by molding and curing that it can be applied to a variety of diffuser arrangements.

What is claimed is:

1. An incombustible diffuser assembly for use in an air conditioning installation to prevent condensation, said assembly comprising: a support frame, and diffuser means mounted to said support frame for controlling the directional flow pattern of air through the diffuser assembly, said diffuser means comprising a plurality of molded diffuser elements defining a plurality of air-diffusing spaces through which air passing through the assembly is diffused, each of said diffuser elements comprising a fibrous inorganic material in an amount of at least 90% by weight and a binder.

2. An incombustible diffuser assembly as claimed in claim 1, wherein said fibrous inorganic material consists only of or mainly of inorganic fibers.

3. An incombustible diffuser assembly as claimed in claim 1, wherein said fibrous inorganic material consists mainly of inorganic fibers and also contains an inorganic powdery material.

4. An incombustible diffuser assembly as claimed in claim 1, wherein said fibrous inorganic material includes ceramic fibers.

5. An incombustible diffuser assembly as claimed in claim 2, wherein said inorganic fibers are ceramic fibers.

6. An incombustible diffuser assembly as claimed in claim 3, wherein said inorganic fibers are ceramic fibers.

7. An incombustible diffuser assembly as claimed in claim 1, wherein said fibrous inorganic material includes any one of the fibers selected from the group consisting of polycrystalline mullite, glass and rockwool fibers.

8. An incombustible diffuser assembly as claimed in claim 2, wherein said fibrous inorganic material includes any one of the fibers selected from the group consisting of polycrystalline mullite, glass and rockwool fibers.

9. An incombustible diffuser assembly as claimed in claim 3, wherein said fibrous inorganic material includes any one of the fibers selected from the group consisting of polycrystalline mullite, glass and rockwool fibers.

10. An incombustible diffuser assembly as claimed in claim 1, wherein said binder is made up of polyvinylalcohol and water glass.

11. An incombustible diffuser assembly as claimed in claim 2, wherein said binder is made up of polyvinylalcohol and water glass.

12. An incombustible diffuser assembly as claimed in claim 3, wherein said binder is made up of polyvinylalcohol and water glass.

13. An incombustible diffuser assembly as claimed in claim 4, wherein said binder is made up of polyvinylalcohol and water glass.

14. An incombustible diffuser assembly as claimed in claim 5, wherein said binder is made up of polyvinylalcohol and water glass.

15. An incombustible diffuser assembly as claimed in claim 6, wherein said binder is made up of polyvinylalcohol and water glass.

16. An incombustible diffuser assembly as claimed in claim 7, wherein said binder is made up of polyvinylalcohol and water glass.

17. An incombustible diffuser assembly as claimed in claim 8, wherein said binder is made up of polyvinylalcohol and water glass.

18. An incombustible diffuser assembly as claimed in claim 9, wherein said binder is made up of polyvinylalcohol and water glass.

* * * * *